US005601059A

United States Patent [19]

White et al.

[11] Patent Number: 5,601,059

[45] Date of Patent: Feb. 11, 1997

[54] FUEL DISTRIBUTION INSERT FOR INTERNAL COMBUSTION ENGINE

[75] Inventors: Brian R. White; Grant W. Hines; Vince E. Notareschi, all of Stillwater, Okla.

[73] Assignee: Brunswick Corporation, Lake Forest, Ill.

[21] Appl. No.: 513,136

[22] Filed: Aug. 9, 1995

[51] Int. Cl.[6] ..... F02M 29/00

[52] U.S. Cl. ..... 123/184.21; 123/590

[58] Field of Search ..... 123/184.21, 590, 123/568

[56] References Cited

U.S. PATENT DOCUMENTS

| | | | |
|---|---|---|---|
| 3,393,984 | 7/1968 | Wisman | 123/590 |
| 4,019,483 | 4/1977 | Konomi et al. | 123/590 |
| 4,274,386 | 6/1981 | Reyes | 123/590 |
| 4,327,698 | 5/1982 | Hamai et al. | 123/568 |
| 4,409,951 | 10/1983 | Whitworthl | 123/590 |
| 5,287,828 | 2/1994 | Kennedy | 123/590 |
| 5,389,245 | 2/1995 | Jaeger et al. . | |
| 5,400,750 | 3/1995 | Jaeger et al. | 123/184.47 |
| 5,435,279 | 7/1995 | Brummer | 123/184.21 |

OTHER PUBLICATIONS

Internal Combustion Engines and Air Pollution, Edward F. Obert, (pp. 412–424), Harper & Row, Publishers.

Electronic Fuel Injection, MerCruiser Stern Drives & Inboards brochure.

*Primary Examiner*—Marguerite McMahon

*Attorney, Agent, or Firm*—Andrus, Sceales, Starke & Sawall

[57] ABSTRACT

An injection-molded, plastic fuel distribution insert for an internal combustion engine having a wet manifold promotes complete fuel atomization and vaporization. The fuel distribution insert also provides for even fuel distribution to the various combustion chambers. The fuel distribution insert preferably has a flange integral with one or more downwardly extending shrouds. Each shroud defines a subchamber having a volume substantially less then the volume of the manifold plenum. A fuel-air mixture from a fuel-air supply source enters into the shroud at the inlet of the intake manifold and is retained within the shroud until the mixture exits one or more exit windows in the shroud. The exit windows in the shroud are placed to promote even fuel distribution.

10 Claims, 3 Drawing Sheets

FIG 4
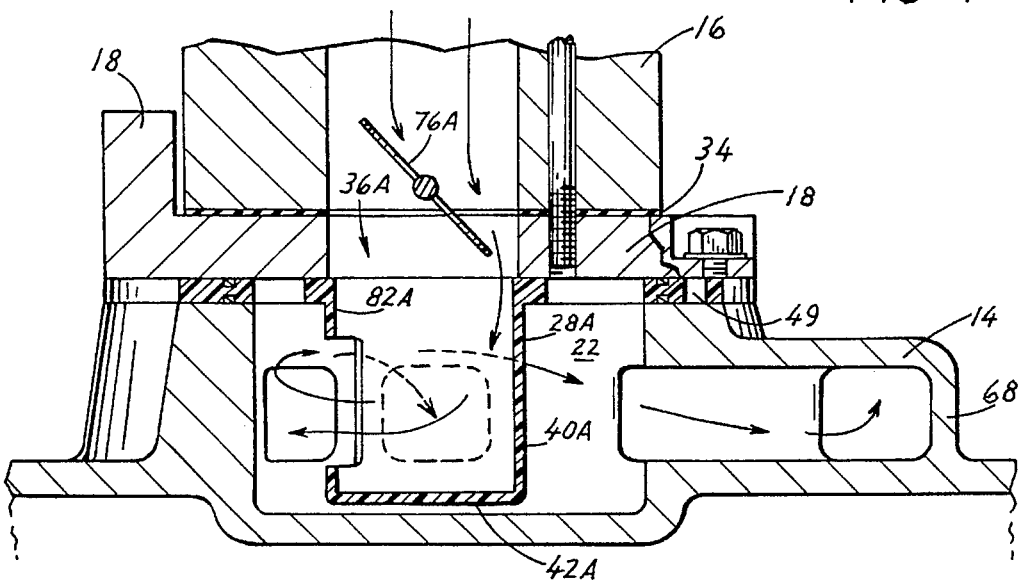
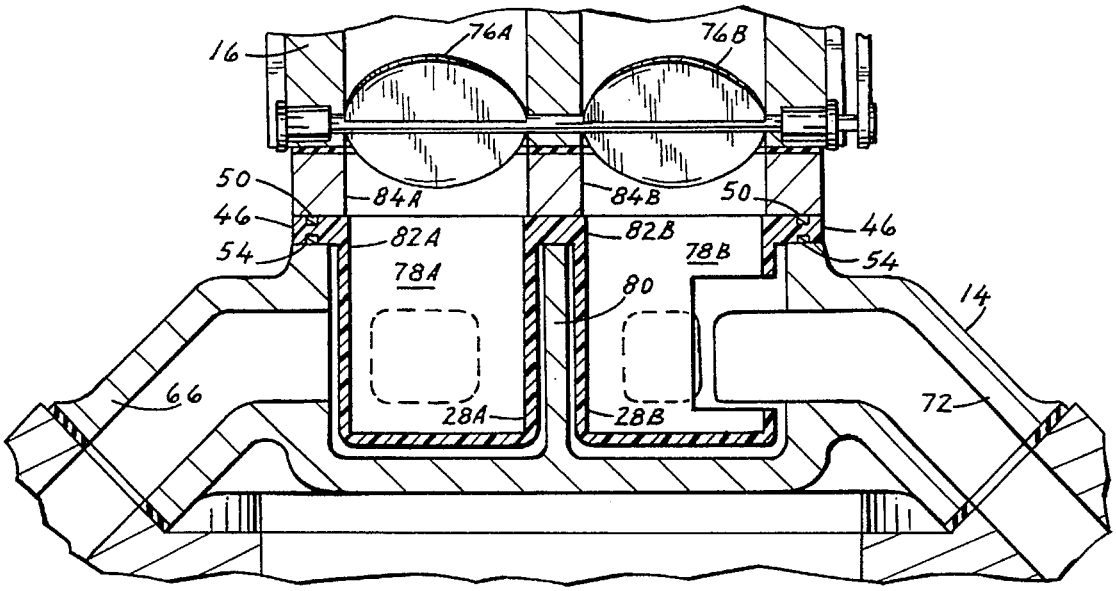
FIG. 5

FUEL DISTRIBUTION INSERT FOR INTERNAL COMBUSTION ENGINE

FIELD OF THE INVENTION

The invention relates to fuel distribution in an internal combustion engine, and in particular to cost effective means of distributing fuel evenly to each of several cylinders in an internal combustion engine.

Background of the Invention

The invention is useful in internal combustion engines having wet manifolds; i.e., internal combustion engines in which a fuel-air mixture flows through an intake manifold inlet into a manifold plenum, and is thereafter distributed through separate runners to the engine combustion cylinders. Typically, the fuel-air mixture is supplied to the intake manifold by a carburetor or a fuel injector throttle body unit having one or more butterfly valves.

In order to have efficient combustion and reduce emissions, each of the combustion cylinders in the engine should receive air and fuel in the proper ratio. Ideally, the air-to-fuel ratio in gasoline engines should be approximately 14.5:1 in each cylinder. In practice, however, some cylinders may be lean on fuel, and some may be lean on air.

To promote efficient combustion, it is also important that the fuel become entrained and well atomized in the air flow before distributing the fuel-air mixture to the separate cylinders. One problem especially prevalent with fuel injector throttle body units is that some of the fuel spray hits the walls in the throttle body and condenses to form a film of fuel on the wall, and the condensed film of fuel has difficulty becoming entrained in the air stream. In some cases, the film can even progress onto the manifold walls. The air and the entrained gaseous and atomized portions of the fuel travel through the manifold at high velocities relative to the large entrained drops of liquid fuel, and relative to any condensed film of fuel on the manifold walls.

One way to improve fuel atomization and vaporization is to use risers or other means for mixing the fuel and air at a location far above the intake manifold, thus providing a longer mixing time before distributing the fuel-air mixture through the manifold plenum, and through the runners to the cylinders. This has the disadvantage of enlarging the height of the engine.

SUMMARY OF THE INVENTION

The primary object of the invention is to promote complete fuel atomization in an internal combustion engine having a wet manifold before the fuel-air mixture is distributed through the manifold plenum to the combustion cylinders, and also provide even fuel distribution to the various combustion chambers. The invention achieves this objective without the use of risers, or otherwise increasing the height between the intake manifold inlet and the fuel-air supply system (e.g. a carburetor or a fuel injector throttle body unit). The invention thus improves overall engine output and efficiency, and reduces emissions while at the same time allowing for compact engine design.

The invention involves the use of a fuel distribution insert at the inlet of a fuel-air intake manifold. The fuel distribution insert has one or more shrouds, preferably one or more round tubes, extending downwardly into the plenum of the intake manifold. Each shroud defines a subchamber having a substantially less volume than the manifold plenum. The fuel-air mixture from the fuel-air supply system (e.g. a carburetor or a fuel injector throttle body unit) is retained within the shroud, and then exits through one or more windows in the shroud into the manifold plenum. Retaining the fuel-air mixture within the shroud promotes fuel vaporization and atomization. The windows in the shroud can be positioned to direct the flow of the fuel-air mixture in the proper direction to distribute fuel and air evenly to the various combustion cylinders.

The fuel distribution insert preferably has an integral flange from which the one or more shrouds extend downwardly. It is preferred that the insert be made of injected molded plastic, and that the flange have a continuous gasket groove therein for receiving a gasket seal. A continuous gasket seal can be molded onto the flange into the continuous gasket groove.

Another particularly advantageous benefit of the invention is that the invention facilitates effective use of two barrel carburetors and two barrel fuel injector throttle body units on four barrel intake manifolds, or the like. The invention therefore eliminates the need to re-engineer engine intake manifolds to provide efficient fuel distribution when the fuel-air supply system (e.g. a carburetor or a fuel injector throttle body unit) does not match the engine intake manifold.

BRIEF DESCRIPTION OF THE DRAWINGS

FIG. 4 is a view taken along line 4—4 in FIG. 3 which further illustrates the flow of fuel-air through the system.

FIG. 5 is a view taken along line 5—5 in FIG. 3.

DETAILED DESCRIPTION OF THE PREFERRED EMBODIMENT

Figure 1:
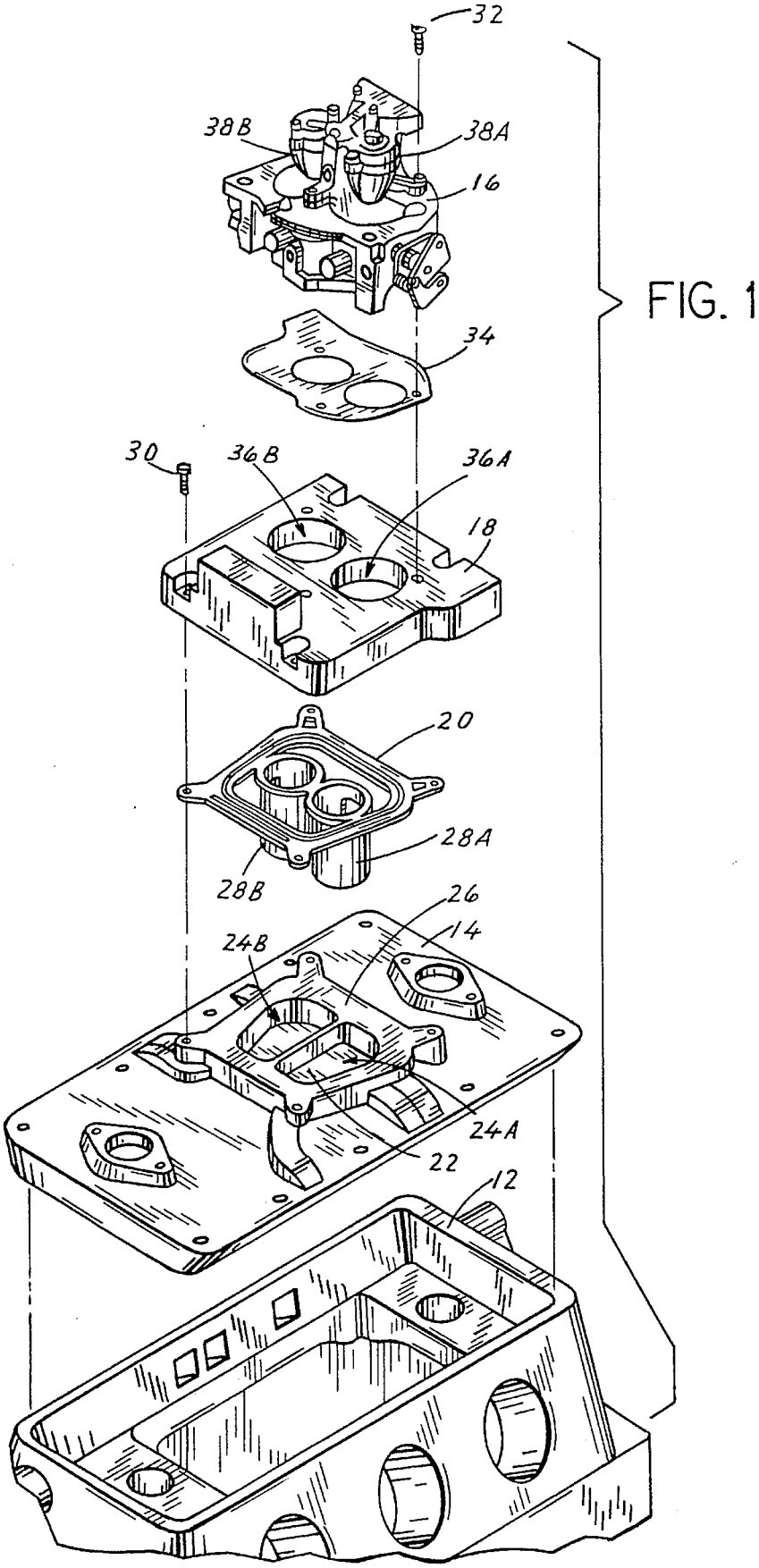
FIG. 1 is an exploded perspective view showing the invention being used with a V6 engine having a four barrel intake manifold and a two barrel fuel injector throttle body unit.

FIG. 1 illustrates part of an internal combustion engine 10 having a V6 engine block 12, a four barrel intake manifold 14, and a two barrel fuel injection throttle body unit 16. FIG. 1 also illustrates an adaptor plate 18 and a fuel distribution insert 20 in accordance with the preferred embodiment of the invention. As illustrated, the invention is incorporated into an engine having a 6 cylinder engine block 12, although it is contemplated that the invention can be used with other types of internal combustion engines.

The intake manifold 14 is supported on the engine block 12, and a manifold plenum 22 is located within the intake manifold. The intake manifold 14 is designed to receive a fuel-air mixture from a four barrel carburetor. The intake manifold has two inlets 24A and 24B. Each of the inlets 24A and 24B is designed to receive a fuel-air mixture from one of two independent pairs of barrels in a four barrel carburetor.

The fuel distribution insert 20 is mounted on the top surface 26 of the inlets 24A and 24B in such a manner that downwardly extended shrouds 28A and 28B extend into the manifold plenum 22. The adaptor plate 18 is mounted to the intake manifold 14 with screws, such as screw 30, which also secure the fuel distribution insert 20 to the intake manifold 14. The two-barrel throttle body unit 16 is secured to the adaptor plate 18 with screws, such as screw 32. A gasket 34 may be placed between the two barrel fuel injection throttle body unit 16 and the adaptor plate 18.

The adaptor plate 18 has two fuel-air passages 36A and 36B passing through the adaptor plate 18. The bottom surface of the adaptor plate 18 is sufficient to cover the inlets 24A and 24B in the intake manifold 14. The throttle body unit 16 is mounted to the adaptor plate 18 in a location so that fuel-air passages 36A and 36B through the adaptor plate 18 are aligned with the inlets 24A and 24B in the intake manifold 14. In this manner, an engine 10 with an intake manifold 14 designed for a four barrel fuel-air supply system can be retrofit to effectively use a two barrel fuel-air supply system, without re-engineering the engine intake manifold 14.

Although FIG. 1 shows a system with a two-barrel fuel injector throttle body unit 16, it should be understood that this type of retrofit can also be used with a two barrel carburetor or even other types of two-barrel fuel-air supply systems. In addition, the use of an adaptor plate in this manner is not limited to adapting four-barrel intake manifolds for use with two-barrel fuel-air supply systems, but applies generally to other engine configurations as well. The fuel distribution insert 20 is especially useful in a system where the intake manifold 14 was not designed primarily for use with the particular fuel-air supply system 16, as is true with the system shown in FIG. 1. In particular, the fuel distribution insert 20 promotes more complete fuel atomization before the fuel-air mixture is distributed through the manifold plenum 22 to the combustion cylinders. In addition, the fuel distribution insert 20 provides a means of directing the flow of the fuel-air mixture in the plenum 22 to evenly distribute fuel and air to the various combustion chambers.

Figure 2:
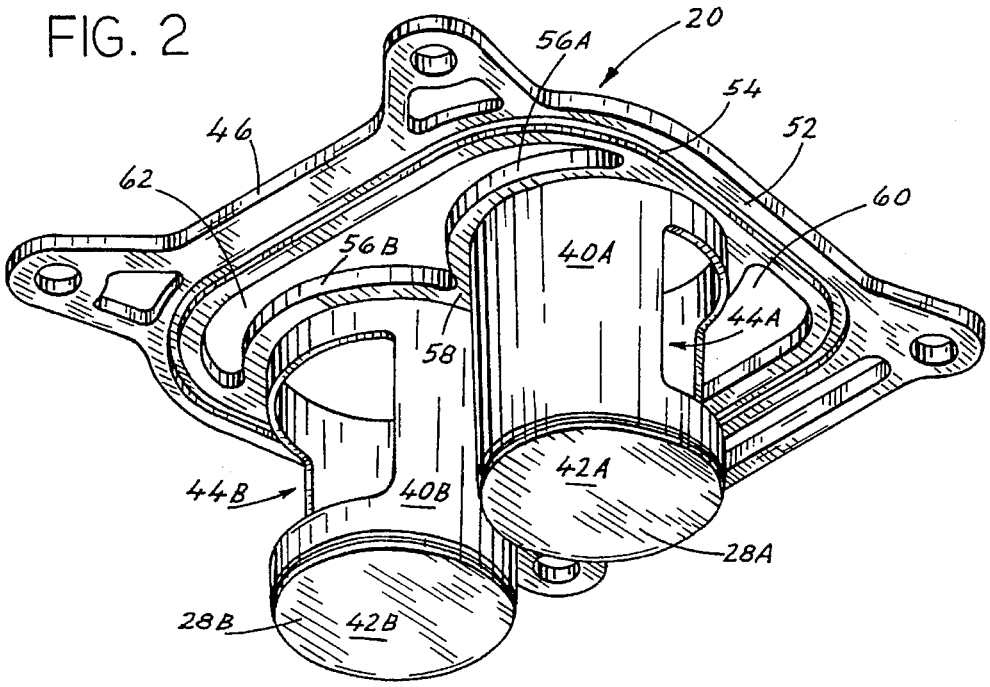
FIG. 2 is a perspective view showing a fuel distribution insert in accordance with the invention.

Referring in particular to FIG. 2, the entire fuel distribution insert 20 is preferably an integral piece made of molded plastic. Specifically, the fuel distribution insert 20 is preferably made of single stage phenolic thermal set composite with a minimum flexural modulus of 1,300,000 psi.

The fuel distribution insert 20 has two downwardly extending shrouds, or tubes 28A and 28B. The shrouds or downtubes 28A and 28B are preferably round tubes each having a round cylindrical sidewall 40A and 40B. Each tube 28A and 28B is open at the top, and preferably (although not necessarily) has an end wall 42A and 42B at the bottom of the cylindrical side wall 40A and 40B. Each shroud 28A and 28B also has an exit window 44A and 44B through which the fuel-air mixture can pass into the manifold plenum 22. In the embodiment of the invention which is shown in the drawings, the exit windows 44A and 44B are through the side walls 40A and 40B of the shrouds 28A and 28B, however in other embodiments of the invention it may be desirable to have another exit window through the end wall 42A and 42B, or to have an exit window exclusively through the end wall 42A and 42B. In addition, it maybe desirable to have more than one exit window through the cylindrical side wall 40A and 40B. The particular embodiment shown in the drawings has been found to be useful in a 4.3 liter four-barrel iron manifold manufactured by General Motors.

The one or more exit windows 44A and 44B in the shrouds 28A and 28B should be large enough so that the amount of total flow of the fuel-air mixture through the shroud into the manifold plenum 22 is not restricted. In other words, there should not be a significant pressure drop as the fuel-air mixture flows through the fuel distribution insert 20 into the plenum 22.

The fuel distribution insert 20 preferably has an integral flange 46 which is used to mount the fuel distribution insert 20 between the top surface 26 of the intake manifold 14, FIG. 1, and the bottom surface 49 of the adaptor plate 18, FIG. 4. The flange 46 has an upper surface 48, FIG. 3, having a continuous gasket groove 50. The flange 46 also has a lower surface 52 having a continuous gasket groove 54. An O-ring can be placed in the gasket groove 50 on the upper surface 48 of the flange 46 to seal between the fuel distribution insert 20 and the adaptor plate 18. Likewise, an O-ring can be placed in the groove 54 in the lower surface 52 of the flange 46 the seal between fuel distribution insert 20 and the upper surface 26 of the intake manifold 14. An alternative to using O-rings in grooves 50 and 54 is to mold a continuous gasket seal onto the lower surface 52 of the flange 46 and onto the upper surface 48 of the flange 46.

The fuel distribution insert 20 has a shroud support portion 56A and 56B for each shroud 28A and 28B. The shroud support portions 56A and 56B are integral with the top portion of the shroud 28A and 28B and extend outwardly therefrom. The shroud support portions 56A and 56B are connected in the center 58, of the fuel distribution insert 20. Each of the shrouds support portions 56A and 56B are also connected to the flange 46, thereby supporting the shrouds 28A and 28B in such a manner that the shrouds extend downward from a horizontal plane defined by the flange 46.

Note that the fuel distribution insert 20 has openings 60 and 62 between the flange 46 and the shroud support portions 56A and 56B. The openings 60 and 62 are covered in this embodiment of the invention from the top by the adaptor plate 18, and it has been found that the fuel-air mixture does not escape passage through openings 60 and 62.

Figure 3:
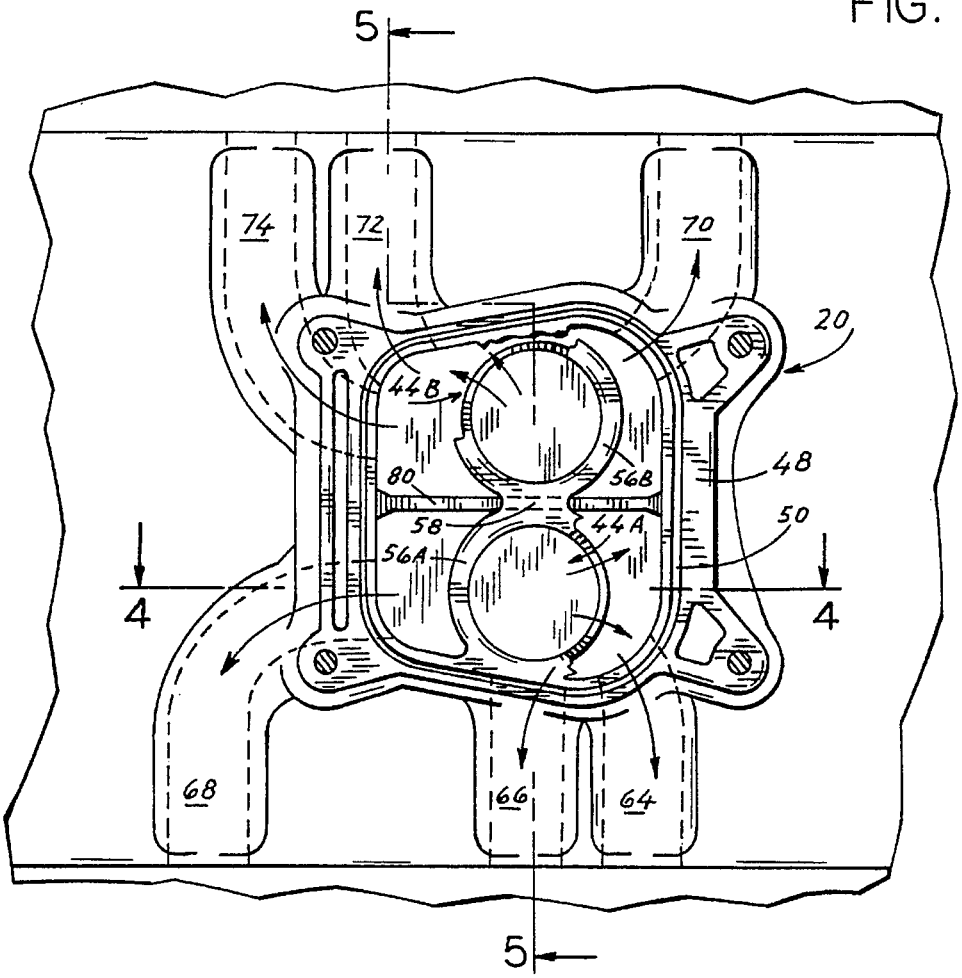
FIG. 3 is a top plan view illustrating fuel-air flow through the fuel distribution insert into a V6 manifold plenum and eventually into runners that lead to the combustion cylinders.

Referring now in particular to FIGS. 3 through 5, the cylindrical side walls 40A and 40B of the shrouds 28A and 28B can extend deep into the plenum 22, thereby retaining the fuel-air mixture within the shrouds 28A and 28B for a longer period of time. In the particular embodiment shown in the drawings, using the fuel distribution insert 20 increases retainment by about 2.25" without substantially increasing the height of the engine. The longer retention time promotes complete atomization before the fuel and air is distributed through the manifold plenum 22 to runners 64, 66, 68, 70, 72, and 74 which provide the fuel to the combustion cylinders of the engine 10.

The fuel-air mixture flows through each barrel of the fuel injector throttle body unit 16 and is controlled in part by butterfly valves 76A and 76B. When butterfly valves 76A and 76B are slanted, the valves 76A and 76B direct the fuel to the rear side of the barrel passage (i.e. the right-hand side in FIG. 4). The fuel-air mixture flows past the slanted butterfly valve 76A and 76B through the passage in the adaptor plate 18 and into the subchamber 78A or 78B within the shroud 28A or 28B. The subchamber 78A and 78B within the shroud 28A and 28B has substantially less volume than the plenum 22.

In the particular embodiment shown in the drawings, the intake manifold 14 has a divider 80 splitting the plenum 22 into two portions having roughly equal volume. The window 44A in shroud 28A faces substantially forward (i.e. the direction opposite the slant of the butterfly valve 76A). It has been found in this embodiment that such a configuration provides even fuel-air distribution to runners 64, 66, and 68.

Note that runners 64 and 66 are located towards the front of the plenum 22, whereas runner 68 is located towards the rear of the plenum 22. With respect to window 44B in shroud 28B, the window 44B should face a direction between outward and rearward (i.e. a direction about 125 degrees counter-clock wise from the forward direction). Note that runners 74 and 72 are located towards the rear of the plenum 22, whereas runner 70 is located towards the front of plenum 22. In this embodiment, it has been found that directing window 44B in this manner provides generally even fuel-air distribution to runners 74, 72, and 70.

In this particular embodiment, the windows 40A and 40B have substantially the same size, each being a rectangle with a dimension of 2 inch by 2 inch. Also in this embodiment, the inside diameter of the shrouds 28A and 28B are also substantially the same, about a 2" diameter.

As can best be seen in FIGS. 4 and 5, the inside diameter of the shrouds 28A and 28B are different than the diameter across the passages 36A or 36B in the adaptor plate 18. In particular, the inner surfaces 82A and 82B of the shrouds 28A or 28B are offset inwardly from the inner walls 84A or 84B of the passages 36A or 36B through the adaptor plate 18. This offset is particularly useful in obstructing the flow of any film of condensed fuel that maybe flowing along the walls of the fuel-air supply systems and/or adaptor plate 18. By obstructing the flow of the film of fuel, the fuel can be more easily entrained within the fuel-air flow through the shroud, and can therefore be more easily atomized before the fuel-air mixture is distributed through the plenum to the runners.

While the invention has been described in conjunction with the preferred embodiment of carrying out the invention, the claims should not be limited to this preferred embodiment. For instance, while the downwardly extending shrouds 28A and 28B promote complete fuel atomization by increasing retention time, the shrouds 28A and 28B also facilitate even fuel-air distribution to the cylinders. If it is not necessary or desirable to increase retention time, the shrouds can be replaced with deflector plates to facilitate even distribution to the cylinders without increasing retention time. This embodiment of the invention may be useful in systems where fuel atomization is sufficient, but fuel-air distribution needs improvement.

Various equivalents or modifications apparent to those skilled in the arts should be considered to be within the scope of the appended claims.

We claim:

1. An internal combustion engine comprising:

a fuel-air supply system;

a fuel-air intake manifold having a plenum and having an inlet receiving a fuel-air mixture from the fuel-air supply system; and a fuel distribution insert at the inlet having at least one shroud extending into the plenum, the shroud defining a subchamber of substantially less volume than the plenum, the shroud being a tube having a sidewall extending generally parallel to the direction of the fuel-air flow through the inlet into the plenum and an end wall enclosing the bottom of the tube, and wherein the shroud has one or more exit windows in the sidewall to the plenum.

2. The invention as recited in claim 1 wherein the fuel-air supply system includes a fuel-injection throttle body.

3. The invention as recited in claim 1 wherein the fuel-air supply system includes a carburetor.

4. The invention according to claim 1 wherein the one or more exit windows are exclusively in the sidewall, and the end wall is a closed wall such that the fuel-air mixture cannot exit through the end wall.

5. The invention as recited in claim 1 wherein the shroud is a downwardly extending tube having a circular tube wall.

6. The invention as recited in claim 1 wherein the one or more exit windows are large enough so that the amount of the total flow of the fuel-air mixture through the shroud into the manifold plenum is not restricted.

7. The invention as recited in claim 1 wherein the one or more exit windows are large enough so that the pressure of the flow through the fuel distribution insert into the manifold plenum does not drop significantly.

8. An internal combustion engine comprising;

a fuel-air supply system;

a fuel-air intake manifold having a plenum and having an inlet receiving a fuel-air mixture from the fuel-air supply system; and a fuel distribution insert at the inlet having a right-side downtube and a left-side downtube each extending into the plenum, each downtube defining a subchamber of substantially less volume than the plenum and each downtube having one or more exit windows to the plenum;

wherein the internal combustion engine is a V6 engine and the fuel-air supply system is a two-barrel throttle body fuel injector having a right-side fuel injector and a left-side fuel injector, each fuel injector having a butterfly valve which slants rearward when open to supply the fuel-air mixture to the intake manifold, and the right-side downtube of the fuel distribution insert corresponds to the right-side fuel injector, the window in the right-side downtube facing substantially forward; and the left-side downtube of the fuel distribution insert corresponds to the left-side fuel injector, the window in the left-side downtube facing towards a direction between outward and rearward.

9. An internal combustion engine comprising:

a fuel-air supply system;

a fuel-air intake manifold having a plenum and having an inlet receiving a fuel-air mixture from the fuel-air supply system;

a fuel distribution insert having at least two shroud support portions connected to each other, a shroud extending from each shroud support portion into the plenum, a flange connected to both shroud supporting portions and an opening between the shroud support portions and the flange, each shroud defining a subchamber of substantially less volume than the plenum and having one or more exit windows to the plenum; and an adapter plate having at least two fuel-air passages therethrough;

wherein the adapter plate is located between the flange and the fuel-air supply system and the fuel distribution insert is secured in place by securing the flange between a top surface of the intake manifold and the adapter plate.

10. The invention as recited in claim 9 wherein the fuel-air supply system is a two-barrel throttle body fuel injection system.

* * * * *